United States Patent [19]

Stiller

[11] 4,037,718

[45] July 26, 1977

[54] FILM RETENTION DEVICE

[76] Inventor: Paul Franklin Stiller, 23675 Smithtown Road, Excelsior, Minn. 55331

[21] Appl. No.: 667,495

[22] Filed: Mar. 17, 1976

[51] Int. Cl.[2] ..... B65D 85/672

[52] U.S. Cl. ..... 206/53; 206/399; 354/344

[58] Field of Search ..... 206/53, 398, 399–402; 354/341, 344, 345

[56] References Cited

U.S. PATENT DOCUMENTS

| | | | |
|---|---|---|---|
| 714,963 | 12/1902 | Steinkamp | 206/53 |
| 2,444,117 | 6/1948 | Sloane et al. | 206/398 |

FOREIGN PATENT DOCUMENTS

| | | | |
|---|---|---|---|
| 866,602 | 12/1952 | Germany | 206/53 |
| 324,718 | 2/1935 | Italy | 206/398 |

*Primary Examiner*—William Price
*Assistant Examiner*—Douglas B. Farrow
*Attorney, Agent, or Firm*—James R. Cwayna

[57] ABSTRACT

A device for holding film strips and the like in proper position on spiral reels or the like such that the film will be held onto the reel in proper spaced relation to permit the flow of the developer about the film for development thereof. The device includes a longitudinally extending body having a transverse dimension which will permit the device to extend across the width of the film and thus the corresponding spiral reel to contact the edges of the film and hold the same against the spirally formed elements of the reel. The device is designed to lock into the reel between the spiral elements thereof and may be used for full or partial strips of film.

15 Claims, 13 Drawing Figures

FILM RETENTION DEVICE

FIELD OF THE INVENTION

This invention relates generally to apparatus for the development of photographic films and the like and more particularly to a device for holding one end of a strip of film onto a spiral mounting device to hold the film during the development process thereof.

BACKGROUND AND OBJECTS OF THE INVENTION

In the processing of roll film the film is not cut into individual views or frames prior to processing but rather, the entire roll is processed at one time. A spiral roll mounting device has been provided for holding the film during the processing thereof and the spiral effect provides a means for holding the turns of the film remotely from one another to allow the proper flow of developer against all of the film surfaces. This spiral unit allows a compact configuration for the developing of film as compared to a system where the film is hung or otherwise rolled out into a continuous line arrangement.

These sprial film holders provide a means for receiving and holding one end of the film strip at the central portion of the spiral reel but to this time there has been no convenient means for locking the other end of the film onto the reel. With no outer locking arrangement, vigorous flow of the developing fluid has been known to dislodge the film from the reel. This situation is particularly aggravated due to the fact that the holder into which the filled reels are placed is agitated during the development process.

The only such holding device of which the applicant is aware provides a unit which overlies the entire free end of the film and when locked into the reel often brings the adjacent rolls of film into contact with each other thus defeating the purpose of the spiral placement of the film.

With applicant's retention or clip device, the free end of a roll of film is engaged on the side edges thereof and these side edges are clamped to the elements forming the sprial of the reel and the clip itself. In this manner, it is possible to place the clip at any radial position of the reel and lock the free end of the film at any pont on the reel. This is particularly important when developing relatively short film strips as the strip, when wound upon the spiral reel, will not extend to the outer periphery thereof.

It is therefore an object of applicants invention to provide a film retention device for holding film strip material onto spiral reel development units which retention device will retain the peripheral edges of the film against the spiral wound elements of the reel and prevent the film from accidentally being removed from or falling from the reel during the development process.

It is a futher object of applicants invention to provide a film retention device for use with spiral development reels wherein the device is deformable and held into the spiral reel through the spring tension thereof.

It is still a further object of applicants invention to provide a film retention device for use with spiral reel film holders of various sizes to therefore accomodate films of various sizes, the reel holder of course being sized in accordance with the film.

It is yet a further object of applicants invention to provide a film retention device which is easily placed into a spiral reel film holding unit and easily removable therefrom and will clamp the peripheral edges of the film during its placement into the reel.

These and other objects and advantages of applicants invention will more fully appear from a consideration of the accompanying specification made in connection with the accompanying drawings and in which the same numeral is utilized to designate the same or similar parts throughout the several views and in which.

Figure 1:
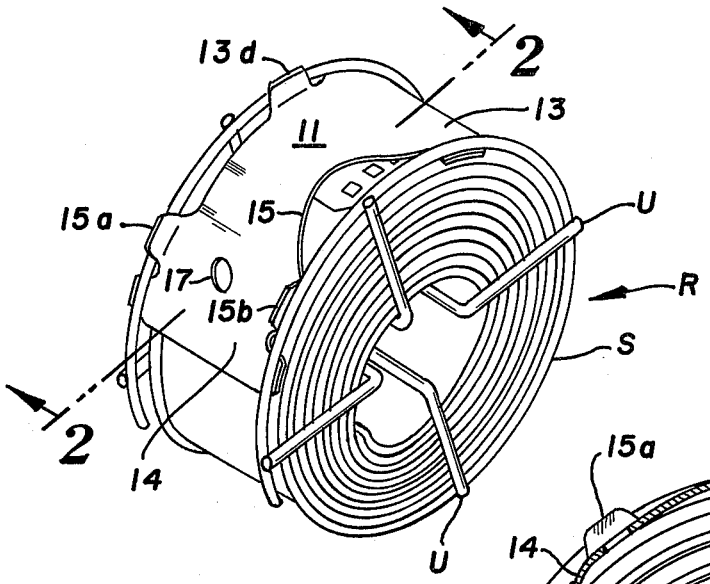
FIG. 1 is a perspective view of a typical spiral film holder having a film strip placed thereon and having the film retention device embodying the concept of applicants invention employed to retain the free end of the film thereon.
Figure 2:
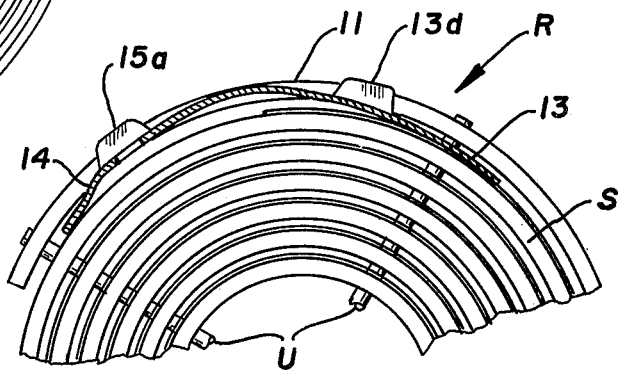
FIG. 2 is a partial side elevation of the spiral reel film holder of FIG. 1.
Figure 3:
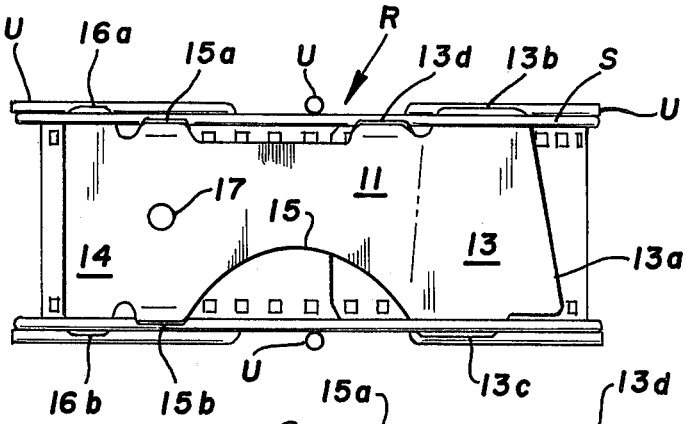
FIG. 3 is a view taken radially outwardly from the film reel holder of FIG. 1 and illustrating the device of applicants invention in position thereon.
Figure 4:
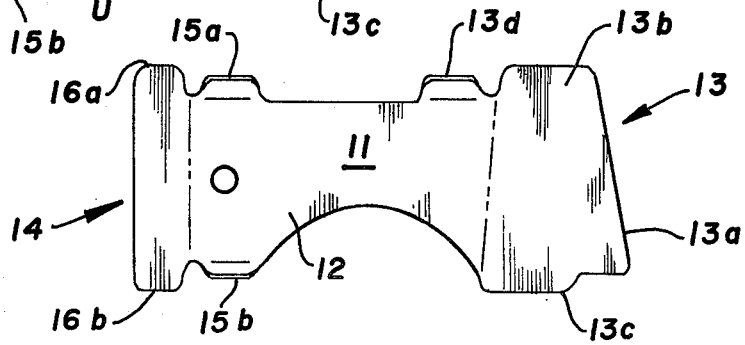
FIG. 4 is a top plan view of a film retention device for a specific film size and as illustrated in FIGS. 1 through 3.
Figure 6:
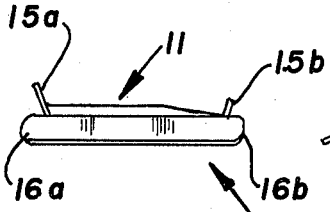
FIG. 6 is an end view of the retention device of FIG. 5.

In accordance with the accompanying drawings, applicant has illustrated a typical spiral, film mounting reel, R, which serves as a mounting device to receive film strips for development. The standard construction of such a reel R includes a plurality of substantially U-shaped elements, U, placed to have the legs thereof to be in radially outstanding relation, with the common joinder member thereof forming the core of the reel R. A supporting core element, not shown, may provide the joinder element upon which the common members are mounted and this supporting core element may, as is common with such core structures, provide a means for capturing one end of the film strip thereon. A spirally formed element S is provided to extend from the core structure and be supported by the radially outstanding legs of the U-shaped elements. This spiral element, provided on both of the legs of this U then provides a means for winding the film strips thereupon such that the film will be held in the reel and the layers thereof are held in spaced apart relation to permit the free flow of fluid therethrough. The width of the reel, being that width or dimension between the spiral elements S, permits the film to be held against transverse movement therein, the legs of the U-shaped elements assisting in this holding, such that the image area lies substantially between the spiral elements S. This particular arrangement is best shown in FIG. 3 wherein the film advance apertures are shown within the boundaries of the spiral elements S.

This sprial reel construction provides a compact arrangement for the placement of film during the development process while still allowing for the proper exposure of the film to the development fluids. It should also be noted that, with this construction, should the outer end of the film strip become loosened from the spiral holding device, the film could possible slide from the spiral reel, unless the free end thereof is retained upon the reel R.

A first form of the invention is illustrated in FIG. 1 through 7 which views illustrate a film strip of a predetermined size and length being mounted upon a spiral reel of a corresponding size and which further illustrates the film retention device for such film and reel. In these various views, the first form of the retention or clip device is designated 11 and is designed to retain and hold one free end of the film strip against the spiral elements of the reel R and have the other end of the clip 11 be retained in the spiral reel R through a spring action or material biasing concept.

The clip element 11 defines a generally longitudinally extending body 12 having a generally arcuately formed central section, which arcuate formation is provided for ease of entry into the reel R and which arcuate formation is not particularly essential to the inventive aspects of the device and which also includes an introductory end portion 13 and a locking end portion 14. These end portions are integrally formed with the body 12. The arcuate design of the body section will permit the ease of introduction of the device into the spiral reel for retention of the film and locking of the device into the reel.

The introductory end portion 13 provides an angularly formed, transversely extending end **13*a* having a pair of transversely outwardly extending elements 13*b*, 13*c*** with a dimension therebetween slightly greater than the dimension between the spiral elements S of the reel R, such that the same will extend outwardly thereof when the unit is placed into position on the reel.

Adjacent one of the outwardly extending elements **13*b* is a first stop element 13*d* and this stop element 13*d* is arranged on the arcuately formed portion of the body 12. This first stop element provides a substantially vertically disposed element to abut with the interior surface of the spiral element S of the reel R and as shown is separated from the introductory end 13*b* of the device by a transversely, inwardly directed depression 14.**

In the form shown, a finger grasping depressed area 15 is formed in oppositely arranged configuration to this first stop element **13*d* and this grasping area 15 extends longitudinally of the body 12. Although this area 15** is defined as an area of reduced transverse dimension, the purpose thereof is to provide a means to grasp the device and this could be accomplished through various formations of the material.

A second pair of stop elements **15*a*, 15*b* are arranged in oppositely directed transverse relation on the body element 12 and these stop elements 15*a*, 15*b* are spaced longitudinally from the first stop element 13*d*. The configuration of these elements is similar to the first stop element and they again are directed substantially angularly upwardly from the body 12. Again, the dimension between such elements 15*a*, 15*b*** is provided to permit the unit to lie within the area defined by the spiral elements S of the reel R.

The locking end portion 14 includes a pair of oppositely directed planar elements **16*a*, 16*b*** which have a transverse dimension greater than that of the body portion such that they may pass externally of the spiral elements S of the reel R and therefore may lock between such elements.

Figure 5:
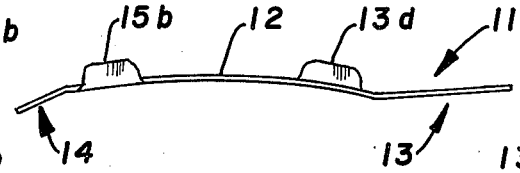
FIG. 5 is a side elevation taken from FIG. 4.
Figure 7:
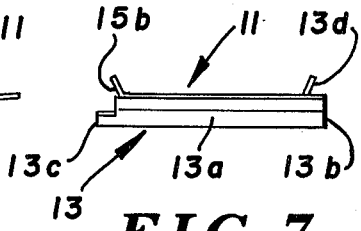
FIG. 7 is an end view of the device illustrated in FIG. 5, opposite to that shown in FIG. 6.
Figure 8:
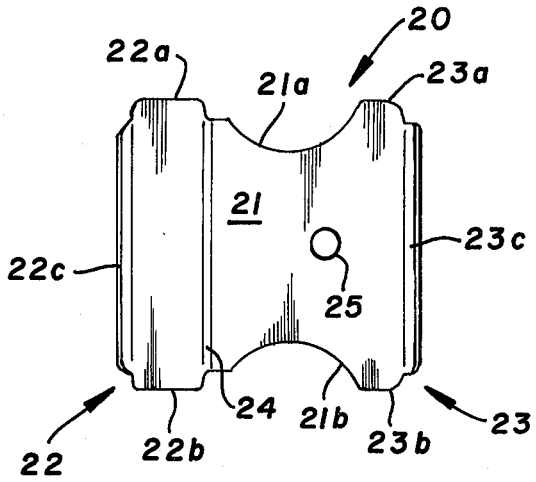
FIG. 8 is a top plan view of a modified form of the film retention device, illustrating the same for a second flm size.
Figure 10:
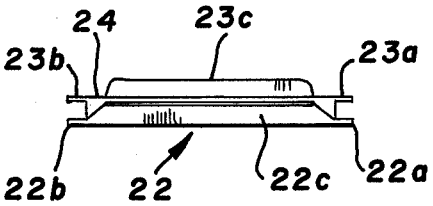
FIG. 10 is an end view of the retention device of FIG. 9.

As illustrated in FIG. 5, the introductory end 13 is generally planar and is offset angularly to the curved central portion of the device. The locking end 14 is similarly planar and is offset angularly to the curved central portion. These configurations aid in the introduction of the unit into the reel R although it should be obvious that the degree of such angularity and curvature may vary and could result in a generally, totally flat configuration without departing from the scope of the invention.

In placing the device into the reel in locking relation to the film strip, the clip 11 is positioned angularly with respect to the reel and the extending tip **13*b* is inserted between adjacent spiral elements S, the end of the film strip being likewise located between these same spiral elements below the end 13 and the other extending end 13*c* is brought into transverse alignment therewith to correspond to the same spiral element position and the clip is then rotated into tangential alignment with the reel. This rotation is controlled by the first stop element 13*d* which will abut with the spiral element upon such rotation and the clip is rotated about this stop 13*d* until the edge of the angular end 13 adjacent tab 13*c* abuts with the spiral. This rotation will bring the entire clip into aligned relation with the reel and at this point, the edges of the film are positioned between the extending tips 13*b*, 13*c*** of the clip and the spiral elements.

Bending of the clip will permit insertion of either end **16*a*, 16*b* into position between the same or another selected set of spiral elements and the stop adjacent thereto, 15*a*, or 15*b* will control the insertion of the end 16*a*, 16*b* into the reel. The remaining tip is positioned into the reel by simply pushing down on the locking end 14** until the appropriate end snaps into proper position in alignment with the first inserted end.

The clip device is formed from a resilient material which will permit the bending of the unit and the resiliency of the material will provide a force tending to return the clip to its normal unstressed position which will result in radially tensioning of the same between spiral elements. The length of the clip and the curvature of the reel provide a stress producing positioning of the clip.

When in proper position within the reel, the upstanding ears elements **13*d*, 15*a* and 15*b*** prevent the clip from moving transversely.

Aperture has been provided for storage of the clip.

The clip of this particular design and the other clips to be discussed herein must obviously be formed of a material which will not react with the development fluid to which the film is exposed.

A modified form of the invention is illustrated in FIGS. 8 through 11. This form of the invention provides the same results as the clip previously discussed but is of a slightly different configuation for placement into a reel of another size.

In this form of the invention, the clip device is designated 20 and again includes a body portion 21, an introductory end 22 and a locking end 23, such ends being arranged on opposite longitudinal sides of the body 21.

Figure 9:
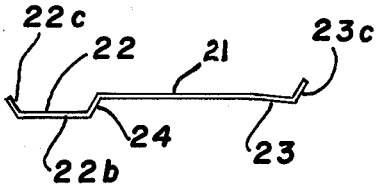
FIG. 9 is a side elevation taken from FIG. 8.
Figure 11:
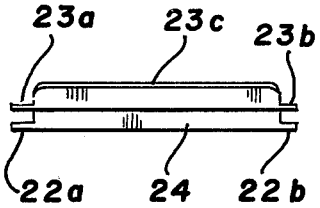
FIG. 11 is an end view of the device illustrated in FIG. 9, opposite to that shown in FIG. 10.

The introductory end 22 includes a pair of tranversely directed, oppositely disposed tabs or ears **22*a*, 22*b*** which are of a dimension to extend through and contact the spiral elements S of the reel R. Outwardly of this introductory end 22 is an upwardly and angularly disposed stiffening portion 22c having a transverse dimension to permit the same to be received between the spiral elements of the reel R. As illustrated in FIG. 9, the introductory end tabs 22a, 22b are arranged at one level and the body portion is joined thereto with a joinder element 24 extending angularly upward from the indroductory end 22 and the transverse width of this joinder element 24 is substantially equal to the width of the lock portion 22c and the body portion 21 such that these elements will be receivable between the spiral elements of the reel R. The combination of the upstanding angular elements 22, 24 prevent transverse movement of the clip when the same is properly positioned on the reel R.

The body portion 21 is provided with a pair of inwardly directed, curved, finger grasping portions 21a, 21b which extend longitudinally of the body 21.

A second pair of ears or tabs 23a, 23b are provided on the body 21, adjacent the arcuate, finger depressions 21a, 21b to form the locking end of the unit and the transverse dimension of these tabs 23a, 23b is substantially equal to that of the first mentioned tabs 22a, 22b such that they will also extend through the spiral elements of the reel R.

Arranged outwardly, longitudinally adjacent the extending tabs 23a, 23b of the locking end 23 is an angularly positioned locking and locating element 23c. The width of this element 23c permits the same to be located between the spiral elements S of the reel R and it should be noted that end 23 is angularly arranged downwardly to the body 21.

With the construction shown, two pairs of transversely extending ears 22a, 22b and 23a, 23b are arranged to extend through the spiral elements S of the reel and two pairs of positioning devices, such as the transverse edges of joinder element 24 and the transverse edges of locating element 23c will hold the clip against transverse movement.

In using this particular device, the clip is rotatively positioned such that either of tabs 22a, 22b will overlie the end of the film strip and extend into the area between spiral elements. Upon rotation of the clip, the other ear 22a, or 22b will be positioned into a transversely opposite spiral area thus locating the film edges against the spiral elements and only contacting the peripheral edges of the film strip. At this point, one of the tabs 23a or 23b is inserted into the outermost spiral of the reel and while lifting at the transverse center thereof the other tab 23a or 23b is bent to lodge transversely across from the first tab.

Again the resiliency of the material allows the minimum deformation to enable the locking of the clip into the reel. Again a storage aperture 25 is provided.

Figure 12:
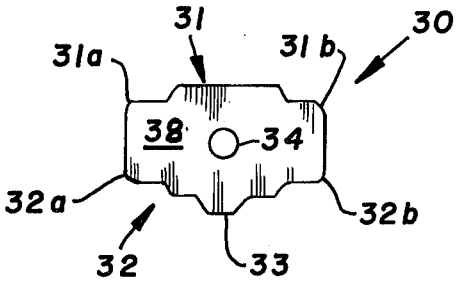
FIG. 12 is a top plan view of yet a third modified form of the invention directed to yet a third size of film; and, FIG. 13 is a side view of the retention device as illustrated in FIG. 12.
Figure 13:
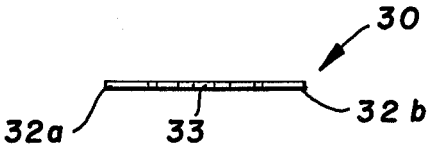

In yet a third form of the invention, applicant provides a film retention clip useable with film strips of relatively small transverse dimension. In the FIGS. 12 and 13 this clip is designated 30 and includes a generally planar element having a pair of transversely extending ears or tabs 31, 32 of a dimension to extend outwardly between the spiral elements S of a reel R while the main body portion 38 thereof is generally rectangular in shape and with the tabs 31, 32 being arranged generally centrally longitudinally of the body 38, four locating edge and corner areas 31a, 31b, 32a,32b are provided for ulitmately locating the body 32 between the spiral elements S of the reel R. A laterally extending tab 33 may be provided on one side of the body 38 for control thereof and again an aperture 34 for hanging is provided.

With this type of planar clip and the corresponding size of the reel, a certain deformation is applied to the clip upon insertion thereof into the reel and the inherent tendency for the material to return to the planar position will provide a holding force for the clip.

A similar installation method, as previously discussed, is applicable to this planar clip and this will normally require a rotation of the clip in order to pass the same into the reel. It should be noted that with the planar clip, no upstanding ears or tabs exist but the areas 31a, 31b, 32a,32b will not follow the spiral and will abut the inner edge of the spiral segment.

In any of the clip devices illustrated, the primary aspects of the invention are available. With the dimensions as illustrated, the clip devices are designed to retain the free end of the film strip, independent of the length thereof and to hold the free end thereof such that the film is retained against possible loss from the reel. The deformable characteristics of the clip element allow positioning of the same at various radial positions on the reel R and the width of the clip allows fitting the same into reels of various sizes.

It should be obvious that applicant has provided a unique clip or film retention device that will hold a film strip of various lengths in a spiral mounting reel.

What I claim is:

1. In combination, a film mounting reel and a film retention device therefore, said combination including:

a. a film mounting reel having a longitudinally extending core portion and a pair of longitudinally spaced film spacing elements arranged on said core portion, said film spacing elements including a sprially formed support member extending laterally from said core, the longitudinal spacing of said support members provided to receive the image area of the film therebetween;

b. the film retention device including a longitudinally extending, planar, body portion of a generally resilient material to allow forming thereof for placement thereof into said reel between said spiral supports thereof; and, c. said body having at least one pair of oppositely directed, transversely extending tab elements, the transverse dimension of said tabs permitting the same to extend transversely into the spiral film supports of said reel for locking between adjacent of such spiral supports to retain the film against one of said spiral supports.

2. The structure set forth in claim 1 and the transverse dimension of said body being less than the transverse dimension of said extending tabs to permit said body to normally lie between the spiral elements of the reel.

3. The structure set forth in claim 2 and said body being provided with at least one stop element on one of the transverse sides thereof, said stop element arranged to extend generally normally to the plane of said body to abut with the internal surface of one of said spiral elements of the reel.

4. The structure set forth in claim 1 and said body defining an introductory end and a locking end, a pair of said tab elements being provided respectively on each of said ends.

5. The structure set forth in claim 4 and at least one of each ends being angularly offset with respect to the plane of said body.

6. The structure set forth in claim 4 and said introductory end being anjularly offset and in longitudinal alignment with said body portion.

7. The structure set forth in claim 4 and said locking end being angularly offset and in longitudinal alignment with said body portion.

8. The structure set forth in claim 4 and said introductory end and said locking end each being angularly offset with respect to the plane of said body.

9. The structure set forth in claim 4 and at least said introductory end being parallely offset with respect to said body portion.

10. The structure set forth in claim 4 and upstanding stop elements being arranged on said body spaced inwardly from the transversely extending ends of said tabs, said stop elements being arranged to normally lie within the spacing between the spiral elements of the reel.

11. The structure set forth in claim 10 and said stop elements being formed from said body portion.

12. The structure set forth in claim 1 and said body portion having finger grasping portions formed therein.

13. The structure set forth in claim 1 and said body portion being generally arcuate in longitudinal configuration.

14. The structure set forth in claim 1 and said device being formed from a material inert to the development fluid to which film is subjected for development thereof.

15. The structure set forth in claim 1 and said device being provided with an aperture therethrough whereby the unit may be hung for storage.

* * * * *